US010985437B2

(12) United States Patent
Knopik et al.

(10) Patent No.: US 10,985,437 B2
(45) Date of Patent: Apr. 20, 2021

(54) INTEGRATED COUPLING DEVICE, IN PARTICULAR OF THE 90° HYBRID TYPE

(71) Applicant: STMicroelectronics SA, Montrouge (FR)

(72) Inventors: Vincent Knopik, Crets en Belledonne (FR); Boris Moret, Artigues-Pres-Bordeaux (FR); Eric Kerherve, Pessac (FR)

(73) Assignee: STMicroelectronics SA, Montrouge (FR)

( * ) Notice: Subject to any disclaimer, the term of this patent is extended or adjusted under 35 U.S.C. 154(b) by 0 days.

(21) Appl. No.: 16/317,082

(22) PCT Filed: Jul. 12, 2016

(86) PCT No.: PCT/FR2016/051794

§ 371 (c)(1),
(2) Date: Jan. 11, 2019

(87) PCT Pub. No.: WO2018/011476

PCT Pub. Date: Jan. 18, 2018

(65) Prior Publication Data

US 2019/0245258 A1 Aug. 8, 2019

(51) Int. Cl.
*H01P 5/18* (2006.01)

(52) U.S. Cl.
CPC ..... *H01P 5/187* (2013.01); *H01P 5/186* (2013.01)

(58) Field of Classification Search
CPC ..... H01P 5/18; H01P 5/185; H01P 5/187
(Continued)

(56) References Cited

U.S. PATENT DOCUMENTS 3,264,586 A * 8/1966 Rabinowitz ..... H01P 1/227 333/81 R
3,371,284 A * 2/1968 Engelbrecht ..... H03F 1/54 330/286

(Continued)

FOREIGN PATENT DOCUMENTS

| | | |
|---|---|---|
| EP | 0669671 A1 | 8/1995 |
| GB | 896707 A | 5/1962 |
| WO | 982141 A1 | 6/1998 |

OTHER PUBLICATIONS

International Search Report and Written Opinion for PCT/FR2016/051794 dated Mar. 23, 2017 (11 pages).

*Primary Examiner* — Dean O Takaoka
(74) *Attorney, Agent, or Firm* — Crowe & Dunlevy

(57) ABSTRACT

A 90° hybrid inductive-capacitive coupling stage includes two first stage terminals capable of forming two stage inputs or two stage outputs and two second stage terminals capable of respectively forming two stage outputs or two stage inputs. The coupling stage is advantageously modular having a first stage axis of symmetry and a second stage axis of symmetry orthogonal to each other with neighboring inductive metal tracks being overlaid in at least one crossing region to form both an inductive circuit and a capacitive circuit. The metal tracks are coupled to the first stage terminals and to the second stage terminals such that the two first stage terminals are situated on one side of the first stage axis of symmetry and the two second stage terminals are situated on the other side of the first stage axis of symmetry.

9 Claims, 8 Drawing Sheets

(58) Field of Classification Search
USPC ..... 333/109, 116, 117
See application file for complete search history.

(56) References Cited

U.S. PATENT DOCUMENTS

| | | | | | |
|---|---|---|---|---|---|
| 3,440,570 | A * | 4/1969 | Kasper | H01P 1/185 | 333/116 |
| 3,737,810 | A * | 6/1973 | Shelton | H01P 1/184 | 333/116 |
| 4,482,873 | A * | 11/1984 | Nyhus | H01P 5/187 | 333/116 |
| 4,532,484 | A * | 7/1985 | Tajima | H01P 5/185 | 333/116 |
| 5,281,929 | A * | 1/1994 | Willems | H01P 5/187 | 333/111 |
| 7,190,240 | B2 * | 3/2007 | Podell | H01P 5/185 | 333/109 |
| 7,808,343 | B1 | 10/2010 | Iannotti et al. | | |
| 2005/0017821 | A1 * | 1/2005 | Sawicki | H01P 5/185 | 333/116 |
| 2012/0019335 | A1 | 1/2012 | Hoang et al. | | |
| 2015/0293304 | A1 * | 10/2015 | Borodulin | H01P 5/185 | 385/42 |

* cited by examiner

INTEGRATED COUPLING DEVICE, IN PARTICULAR OF THE 90° HYBRID TYPE

PRIORITY CLAIM

This application is a 371 filing from PCT/FR2016/051794 filed Jul. 12, 2016, the content of which is incorporated by reference.

TECHNICAL FIELD

Various embodiments relate to coupling devices, and more particularly, the coupling devices comprising a 90° hybrid coupling stage designed, by way of non-limiting example, to be interposed between power devices such as power amplifiers.

The coupling device is for example applicable to a transmission chain of a wireless communications device.

BACKGROUND

Generally speaking, a coupling device comprises inductive elements and capacitive elements that are fixed for a given coupling frequency band. In general, these inductive elements and notably these capacitive elements are not directly modular. The coupling frequency band is therefore usually narrow and limited.

Furthermore, 90° hybrid coupling devices conventionally comprise a first terminal designed to receive/deliver an input/output signal of the asymmetric, or single-ended, type, a second isolation terminal coupled to a load having an impedance of 50 ohms and connected to ground, and a third and a fourth terminal each designed to receive/deliver an input/output signal. These two input/output signals are phase-shifted by 90° with respect to each other.

Such a device conventionally operates according to two modes: a power divider mode and a power combiner mode.

In the power divider mode, the device receives a power input signal at the first terminal and delivers, respectively to said third and fourth terminals, a first power output signal and a second power output signal. In theory, each of these first and second output signals comprises half the power of said power input signal and these first and second output signals are phase-shifted by 90° with respect to each other.

In the power combiner mode, the device receives, respectively at the third and fourth terminals, a first and a second power input signal, and delivers at the first terminal an output signal whose power is the sum of the powers of the first and second power input signals. In theory, said first and second input signals are also phase-shifted by 90° with respect to each other.

However, achieving an amplitude and/or phase balance between the input/output signals of said third and fourth terminals is difficult. For coupling devices comprising coils as inductive elements, the size of these devices is generally too large for them to be implemented, for example, in an integrated circuit.

Furthermore, said third and fourth terminals are generally situated in different sides within said conventional coupling devices. As a consequence, it is necessary to carry out certain specific adaptations for components coupled to said coupling devices. These components cannot be disposed in a parallel manner and said coupling device needs a larger fingerprint on silicon as a consequence.

SUMMARY

According to one embodiment, an improvement is provided in the modularity of a coupling device of the 90° hybrid type while at the same time allowing a good symmetry to be conserved. A technical solution is also provided independent of the technologies used, together with a topology of limited size, for implementing high performance coupling devices.

Thus, according to one aspect, a coupling device is provided comprising an inductive-capacitive 90° hybrid coupling stage comprising two first stage terminals capable of forming two stage inputs or two stage outputs and two second stage terminals capable of respectively forming two stage outputs or two stage inputs.

According to a general feature of this aspect, the coupling stage comprises a first stage axis of symmetry and a second stage axis of symmetry, orthogonal to the first stage axis of symmetry, and comprises neighboring inductive metal tracks being overlaid in at least one crossing region and designed to form both an inductive circuit and a capacitive circuit, and coupled to the first stage terminals and to the second stage terminals such that the two first stage terminals are situated on the side of the first stage axis of symmetry, whereas the two second stage terminals are situated on the other side of the first stage axis of symmetry.

Such a coupling stage can advantageously be modular and may comprise one or more modules, of different or identical types, so as to be able to obtain a desired overall inductive value, a desired overall capacitive value and/or a desired fingerprint on silicon while at the same time adjusting the length, the width and the distance between neighboring inductive metal tracks notably within said crossing region.

Furthermore, the input terminals in combiner mode or the output terminals in divider mode of said coupling stage are advantageously situated in the same side by virtue of the overlaid topology, a fact which furthermore allows the overall size of said coupling device to be reduced.

According to one embodiment, the device comprises at least a first module having a first module axis of symmetry and a second module axis of symmetry orthogonal to the first module axis of symmetry and comprising two first neighboring inductive metal tracks situated, in part, on either side of the two axes of symmetry of the first module and overlaid in a crossing region containing the second module axis of symmetry, the two ends of the two first metal tracks situated on one side of the first axis of symmetry forming two first module terminals, the two ends of the two first metal tracks situated on the other side of the first axis of symmetry forming two second module terminals, the two first metal tracks forming both a first inductive circuit and a first capacitive circuit, the two first module terminals are coupled to the two first stage terminals and the two second module terminals are coupled to the two second stage terminals, the first stage axis of symmetry being parallel to the first module axis of symmetry and the second stage axis of symmetry being parallel to the second module axis of symmetry.

Advantageously, the two first module terminals, the two second module terminals and one of the two first metal tracks may for example be situated in a first plane and the other of the two first metal tracks may be situated in a second plane, different from said first plane.

It should be noted that the two first metal tracks situated in the different planes and being overlaid in the crossing region also form a capacitor of said first module.

According to one embodiment, the coupling stage comprises at least one branch comprising several first modules coupled directly or indirectly in series.

According to another embodiment, the coupling stage comprises at least one branch comprising at least one group containing a first module coupled in series between two second modules, each second module having the first module axis of symmetry and comprising two second neighboring inductive metal tracks situated on either side of the first module axis of symmetry, the two second metal tracks forming both a second inductive circuit and a second capacitive circuit, the two ends of the two second metal tracks situated on one side of the first module axis of symmetry forming two third module terminals, the two ends of the two second metal tracks situated on the other side of the first module axis of symmetry forming two fourth module terminals, a third module terminal of each of the two second modules being coupled to a first respective stage terminal and a fourth module terminal of each of the two second modules being coupled to a second respective stage terminal.

By way of example, the two second neighboring inductive metal tracks are advantageously situated in said first plane.

The device may for example comprise at least one branch comprising a first module at each end of said branch and said at least one group coupled in series between the two first end modules.

According to yet another embodiment, the device comprises several parallel branches and two connection inductive metal tracks parallel to the second stage axis of symmetry coupled between two parallel neighboring branches.

By way of non-limiting example, the coupling stage may comprise at least one adjustment capacitor coupled in parallel onto the superposed parts of the two first metal tracks within the crossing region of said at least one first module. Here, the purpose of said adjustment capacitor is to add to the capacitive value between the two first metal tracks, in other words the capacitive value of said first module.

By way of example, the coupling stage may have an overall inductive value, an overall capacitive value, dimensional constraints measured along the two stage axes of symmetry, and the type of module together with the number and the size of the modules and of the connection tracks and of the adjustment capacitors forming said coupling stage are chosen so as to comply with the overall inductive value, the overall capacitive value and said dimensional constraints.

It should be noted that the respective lengths and widths of the branches and of the parallel branches and of the two inductive metal connection tracks are adjustable in order to obtain different capacitive and inductive values for said coupling stage.

Furthermore, the coupling stage may be a coupling stage of the radio frequency type.

According to one mode of operation, said device forms a power divider one of the two first stage terminals of which is designed to receive an input signal, the other of the two first stage terminals is coupled to a load having a fixed impedance and being connected to ground so as to be isolated, and the two second stage terminals are each designed to deliver an output signal, the output signals being phase-shifted by 90° with respect to each another.

According to another mode of operation, the device forms a power combiner whose two second stage terminals are each designed to receive an input signal, one of the two first stage terminals being designed to deliver an output signal and the other of the two first stage terminals is coupled to a load, having a fixed impedance and being connected to ground so as to be isolated, the input signals being phase-shifted by 90° with respect to each other.

According to yet another mode of operation, said device forms a phase-shift device one of the two second stage terminals of which is designed to receive an input signal, the other of the two second stage terminals is designed to deliver an output signal, and the two first stage terminals are respectively coupled to a first and to a second load having a variable impedance and being connected to ground.

According to another aspect, a transmission chain is provided, comprising a power divider such as defined hereinbefore, a power combiner such as defined hereinbefore, and two power amplifiers respectively coupled between the two second stage terminals of said divider and the two second stage terminals of said combiner.

According to yet another aspect, a wireless communications device is provided comprising a transmission chain such as defined hereinabove.

According to yet another aspect, an electronic apparatus is provided comprising a phase-shift device such as defined hereinabove.

BRIEF DESCRIPTION OF THE DRAWINGS

Other advantages and features of the invention will become apparent upon examining the detailed description of embodiments, which are in no way limiting, and from the appended drawings in which.

DETAILED DESCRIPTION

Figure 1:
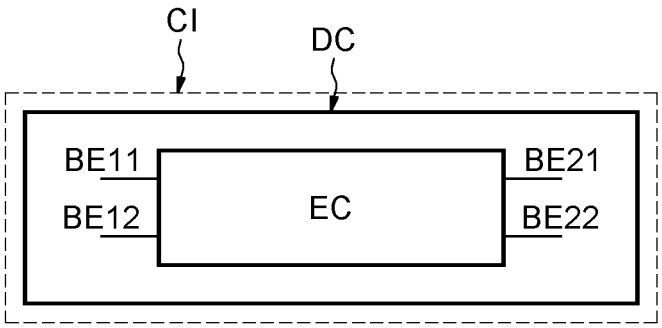
FIG. 1 illustrates one example of a coupling device implemented in an integrated circuit on silicon.

FIG. 1 illustrates one example of a coupling device DC implemented in an integrated circuit CI on silicon.

Said coupling device DC here comprises a coupling stage EC of the 90° hybrid type.

In other words, the coupling stage EC can operate according to two different modes: a divider mode DIV and a combiner mode COMB. Said coupling stage EC comprises two first stage terminals BE11 and BE12 and two second stage terminals BE21 and BE22.

Figure 2:
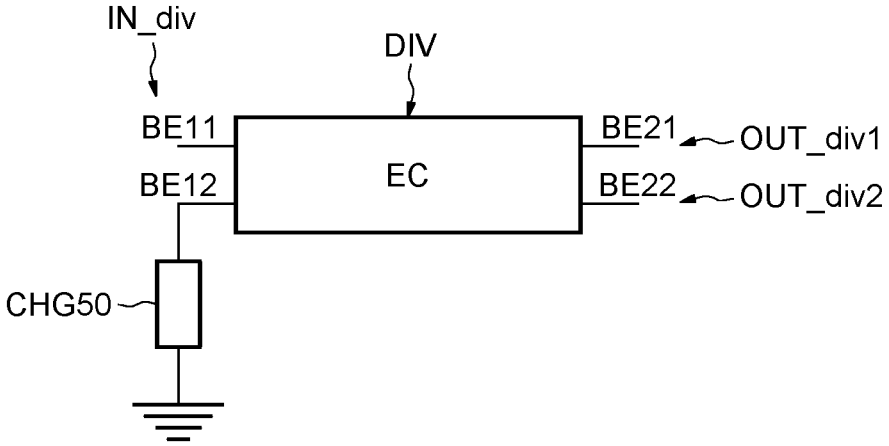
FIG. 2 illustrates a divider mode of operation.

In the divider mode DIV illustrated in FIG. 2, one of the two first stage terminals BE11 receives an input signal IN_div and the other of the two first stage terminals BE12 is coupled to a load CHG50 having a fixed impedance, typically 50 ohms, itself connected to ground. The two second stage terminals BE21 and BE22, in this divider mode DIV, each deliver an output signal OUT_div1 and OUT_div2. In theory, these two output signals OUT_div1 and OUT_div2 are phase-shifted by 90°. Each of the two output signals OUT_div1 and OUT_div2 has a power equal to half of the power of the input signal IN_div.

Figure 3:
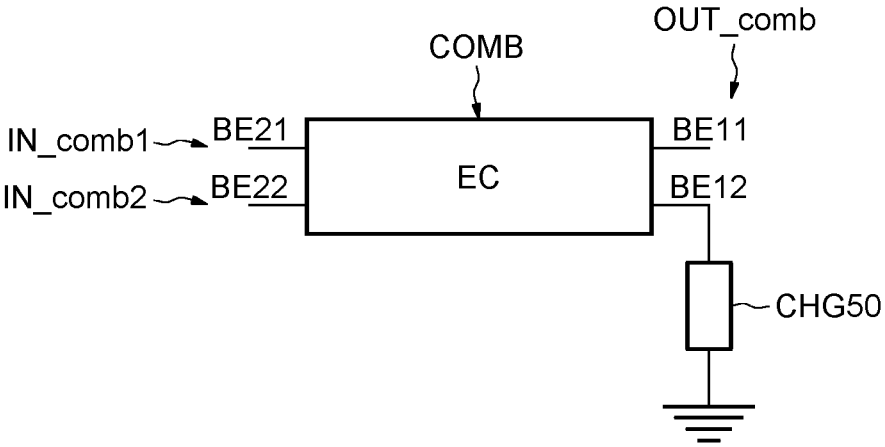
FIG. 3 illustrates a combiner mode of operation.

With regard to the combiner mode COMB illustrated in FIG. 3, the two second stage terminals BE21 and BE22 are each used to receive an input signal IN_comb1 and IN_comb2. The two input signals IN_comb1 and IN_comb2 are ideally phase-shifted by 90° with respect to each other. One of the two first terminals BE11 delivers an output signal OUT_comb and the other of the two first terminals BE12 is coupled to said load CHG50, having a fixed impedance, typically 50 ohms, and connected to ground. In theory, the power of the output signal OUT_comb is equal to the sum of the powers of the two input signals IN_comb1 and IN_comb2.

As can be seen in FIGS. 2 and 3, the two first stage terminals BE11 and BE12 and the two second stage terminals BE21 and BE22 are respectively situated on the same side of said stage EC. This feature advantageously allows a coupling in parallel between said coupling stage EC and components coupled to said stage, for example power amplifiers which will be described in more detail hereinafter in the description. For this reason, the space required by the coupling stage EC and components coupled to said stage can be considerably reduced.

The coupling stage EC may advantageously be modular. In other words, the coupling stage EC may comprise one or more modules, which may be configured according to the desired overall inductive and capacitive value and/or the desired size of said coupling device.

The coupling stage EC furthermore comprises metal tracks being overlaid in at least one crossing region so as to allow the input terminals in combiner mode COMB and the output terminals in divider mode DIV situated in the same side of said device to be obtained.

Figure 4:
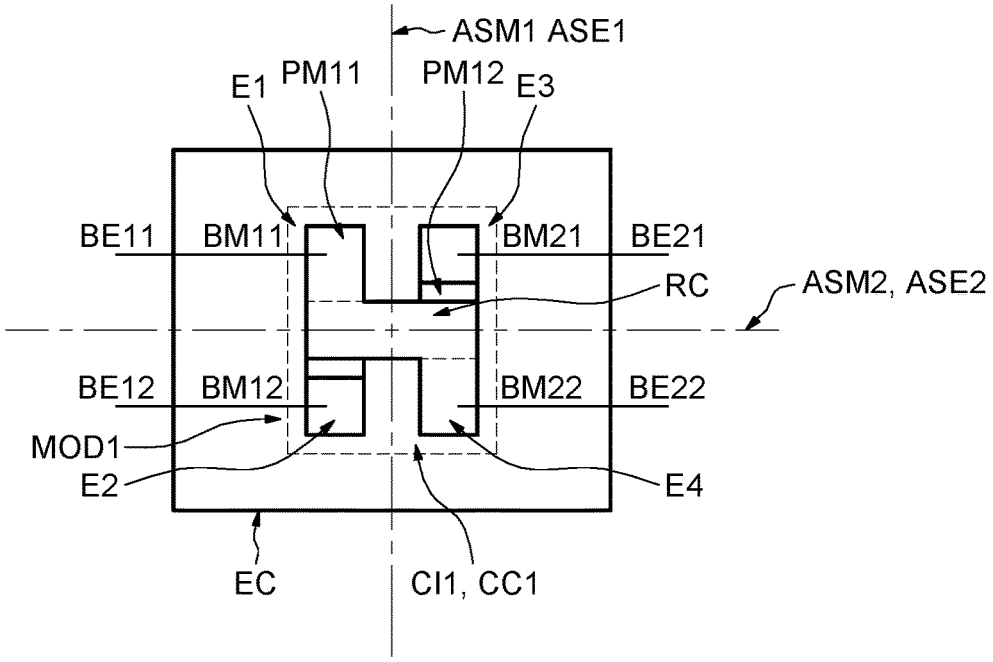
FIG. 4 illustrates one example of a first topology of the coupling stage.

Reference is now made to FIG. 4 in order to illustrate one example of a first topology of the coupling stage EC.

The coupling stage EC here comprises a first module MOD1 comprising a first module axis of symmetry ASM1 and a second module axis of symmetry ASM2. Said second module axis of symmetry ASM2 is orthogonal to the first module axis of symmetry ASM1.

The first module MOD1 further comprises two first neighboring inductive metal tracks PM11 and PM12 situated, in part, on either side of the two module axes of symmetry ASM1 and ASM2 of the first module MOD1 and a crossing region RC in which the two metal tracks PM11 and PM12 are overlaid along the second module axis of symmetry ASM2.

Two ends E1 and E2 of the two first metal tracks PM11 and PM12 situated on one side of the first axis of symmetry ASM1 form two first module terminals BM11 and BM12. Two other ends E3 and E4 of the two first metal tracks PM11 and PM12 situated on the other side of the first axis of symmetry ASM1 form two second module terminals BM21 and BM22. The two first metal tracks PM11 and PM12 form both a first inductive circuit CD and a first capacitive circuit CC1. The two first module terminals BM11 and BM12 are coupled to the two first stage terminals BE11 and BE12 and the two second module terminals BM21 and BM22 are respectively coupled to the two second stage terminals BE21 and BE22.

For this reason, the coupling stage EC is indeed symmetrical with respect to a first stage axis of symmetry ASE1 parallel to the first module axis of symmetry ASM1. The coupling stage EC is also symmetrical with respect to a second stage axis of symmetry ASE2 parallel to the second module axis of symmetry ASM2.

In the case of a coupling stage EC comprising only one first module MOD1, said first and second stage axes of symmetry ASE1 and ASE2 are indeed respectively superposed onto said first and second module axes of symmetry ASM1 and ASM2.

The two first stage terminals BE11 and BE12 are situated on one side of the first stage axis of symmetry ASE1, whereas the two second stage terminals BE21 and BE22 are situated on the other side of the first stage axis of symmetry ASE1.

Figure 5:
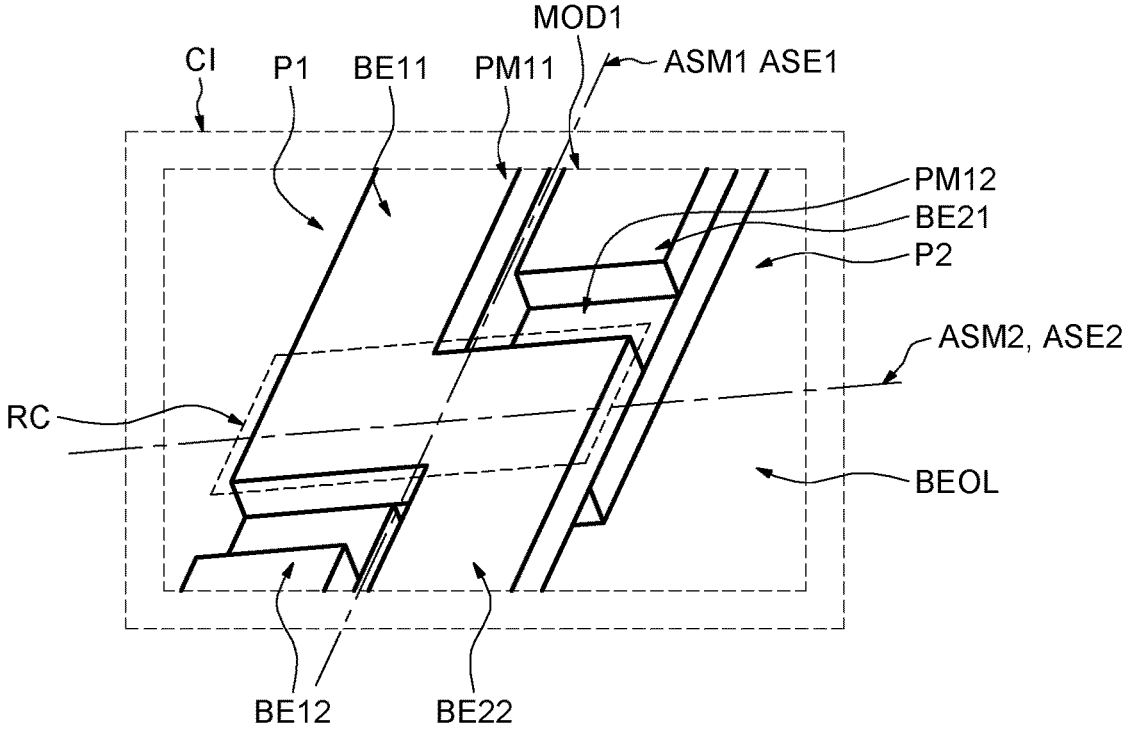
FIG. 5 is a perspective view of FIG. 4.

As illustrated in FIG. 5 which is a perspective view of FIG. 4, the two first stage terminals BE11 and BE12, the two second stage terminals BE21 and BE22 and one of the first metal tracks PM11 are situated in a first plane P1 of said integrated circuit CI. The other first metal track PM12 is situated in a second plane P2 different from said first plane P1 within the integrated circuit CI. It should be noted that the first and second planes P1 and P2 are advantageously located within the interconnection part (BEOL: Back End Of Line) of the integrated circuit CI and, more particularly, within the upper region of this BEOL part so as to facilitate the implementation of said coupling stage EC.

The first stage terminal BE12 and the second stage terminal BE21 are coupled to the first metal track PM12 situated in the second plane P2. This topology advantageously allows said crossing region RC to be created along the second stage axis of symmetry ASE2. This crossing region RC in two levels indeed forms the majority of the capacitive value of said first module MOD1. The two first metal tracks PM11 and PM12 mainly influence the inductive value of said first module MOD1.

Said first module MOD1 forms an important module of said coupling stage EC. By way of example, the first module MOD1 has a capacitive value of 12.9 fF and an inductive value of 8 pH.

In order to obtain desired overall capacitive and inductive values in said coupling stage EC, several different embodiments are provided (see, FIGS. 6 to 10) and use a larger or smaller number of modules with identical or different configurations, with at least one of the modules being a first module such as illustrated in FIGS. 4 and 5.

Figure 6:
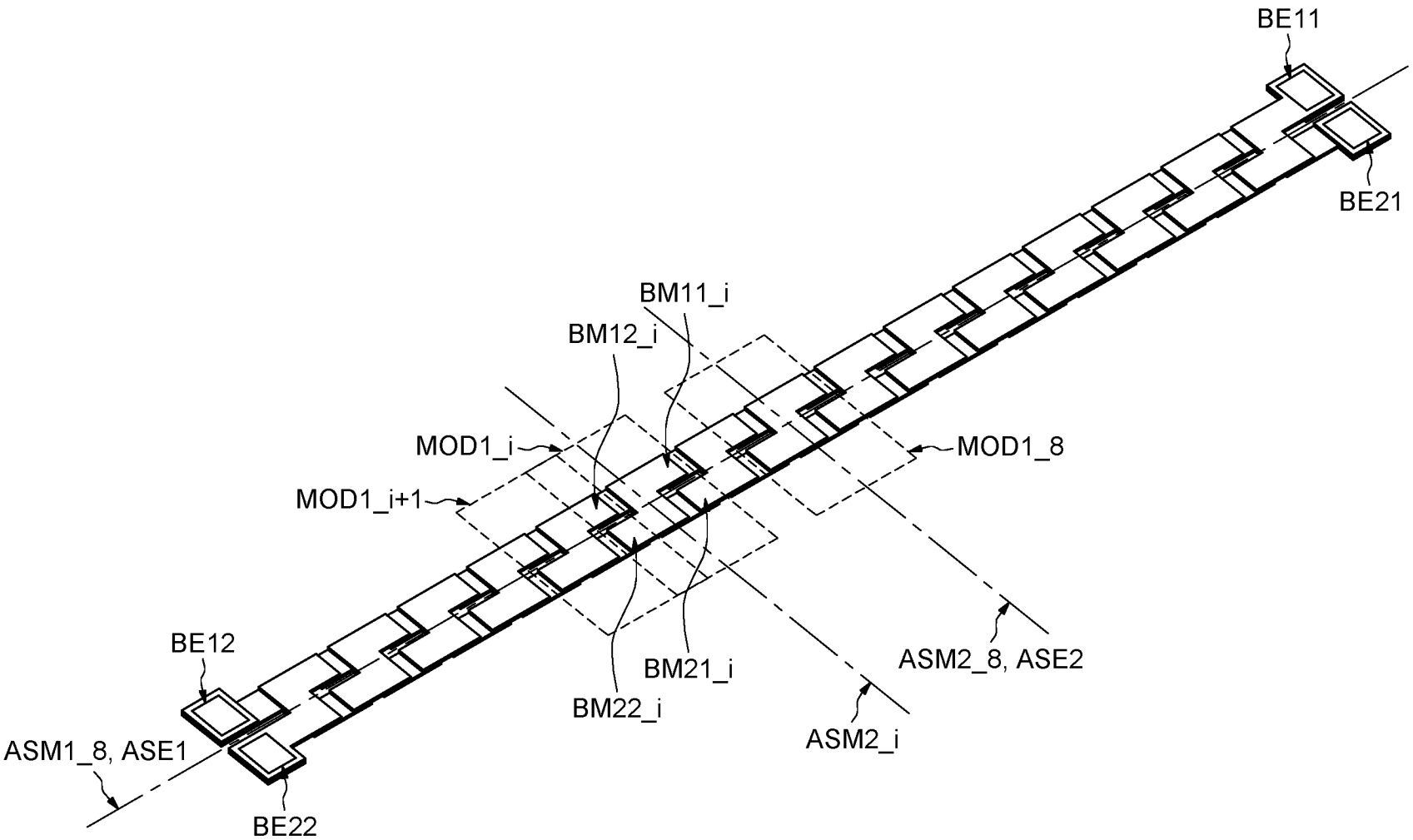
FIG. 6 illustrates a series coupling of modules.

Thus, the coupling stage EC may advantageously comprise, for example, a branch B comprising an odd or even number (preferably odd) of first modules MOD1 coupled in series (FIG. 6).

The first and the second module terminals BM11_*i* and BM21_*i* or BM12_*i* and BM22_*i* situated on one side of the second module axis of symmetry ASM2_*i* of a first module MOD1_*i* are respectively coupled to the first and to the second stage terminals BE12_*i*+1 and BE22_*i*+1 or BE11_*i*+1 or BE21_*i*+1 situated on the other side of the second module axis of symmetry ASM2_*i*+1 of another adjacent first module MOD1_*i*+1. The first modules MOD1_*i* may be directly coupled in series (FIG. 6) or else indirectly via other types of modules as illustrated in FIG. 7.

In the example illustrated in FIG. 6, said branch B comprises fifteen first modules coupled in series. The first and second stage axes of symmetry ASE1 and ASE2 are respectively superposed onto the first and second axes of symmetry ASM1_8 and ASM2_8 of the eighth first module MOD1_8. In the case where the stage EC only comprises the branch B, the terminals of the first module and of the last module situated at the two ends of said branch B form the first BE11, BE12 and second terminals BE21, BE22 of said stage EC.

Figure 7:
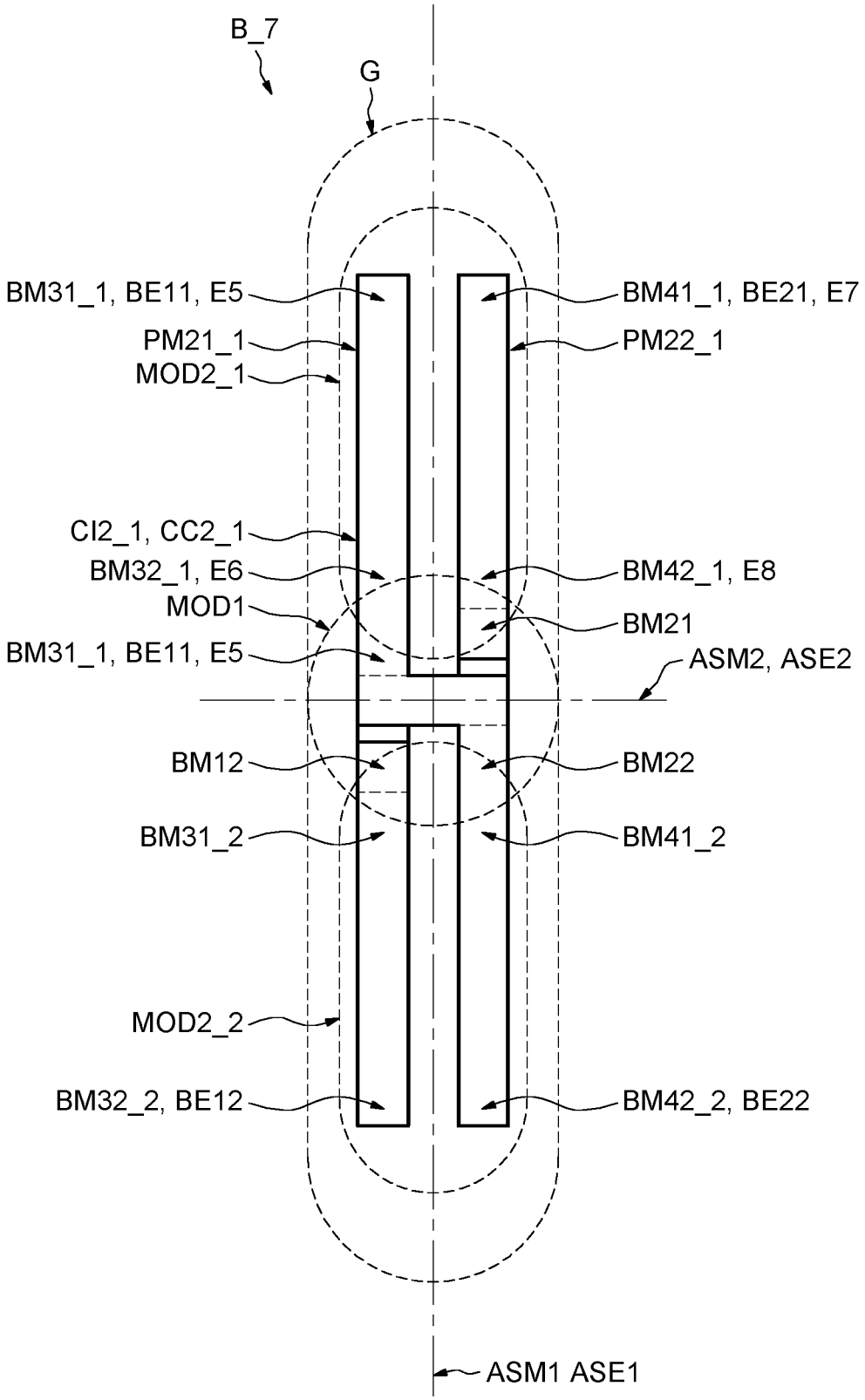
FIGS. 7-10 illustrate other embodiments of a coupling stage.

FIG. 7 illustrates another embodiment. Said coupling stage EC here comprises a branch B_7 comprising a group G containing a first module MOD1 coupled in series between two second modules MOD2_1 and MOD2_2.

The first second module MOD2_1 comprises a first module axis of symmetry ASM1_1 and two second neighboring inductive metal tracks PM21_1 and PM22_1 situated on either side of the first module axis of symmetry ASM1_1.

The two second metal tracks PM21_1 and PM22_1 form both a second inductive circuit CI2_1 and a second capacitive circuit CC2_1. The inductive value of the second inductive circuit CI2_1 and the capacitive value of the second capacitive circuit CC2_1 may be adjusted by respectively modifying the length of the second metal tracks PM21_1 and PM22_1 and the interval between the second metal tracks PM21_1 and PM22_1.

Furthermore, the two ends E5 and E6 of the two second metal tracks PM21_1 and PM22_1 situated on one side of the first module axis of symmetry ASM1_1 form two third module terminals BM31_1 and BM32_1, whereas the two ends (E7, E8) of the two second metal tracks PM21_1 and PM22_1 situated on the other side of the first module axis of symmetry ASM1_1 form two fourth module terminals BM41_1 and BM42_1.

Furthermore, a third module terminal BM31_1 or BM32_2 of each of the two second modules MOD2_1 and MOD2_2 is coupled to a respective first stage terminal BE11 or BE12 and a fourth module terminal BM41_1 or BM42_2 of each of the two second modules MOD2_1 and MOD2_2 is coupled to a respective second stage terminal BE21 or BE22.

Said second metal tracks PM21_1 and PM22_1 of said first second module MOD2_1 are therefore advantageously situated in the same first plane P1 as the first and second stage terminals BE11, BE12, BE21 and BE22.

For this reason, said branch B comprising said group G can indeed individually form a 90° hybrid coupling stage EC. The first and second stage axes of symmetry ASE1 and ASE2 are superposed onto the first and second axes of symmetry of said first module ASM1 and ASM2.

In other words, a coupling stage EC can be formed by using a branch B comprising one or more first modules MOD1 coupled in series and/or coupled with one or more group(s) G.

Figure 8:
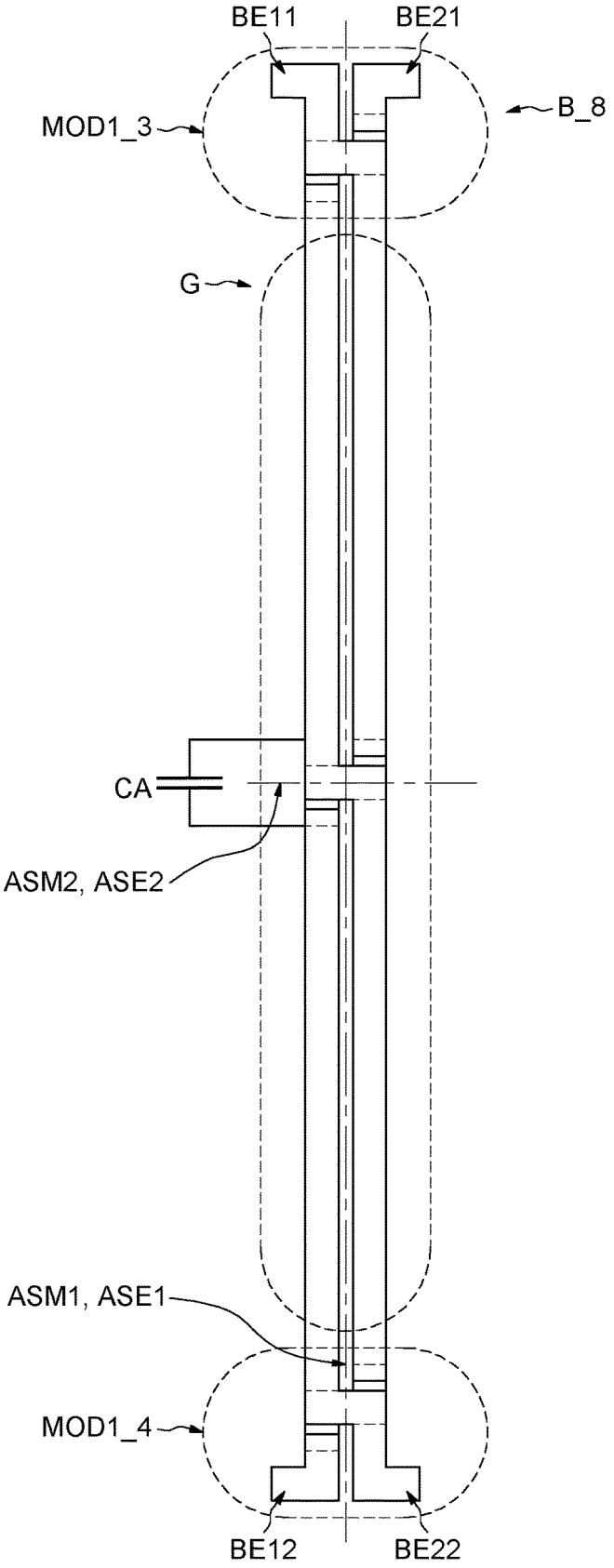

By way of non-limiting example, FIG. 8 illustrates a coupling stage EC comprising a branch B_8 comprising a first module MOD1 at each end of said branch B_8 and said at least one group G coupled in series between the two first end modules MOD1_3 and MOD1_4.

Said two first modules MOD1_3 and MOD1_4 are symmetrical with respect to the first axis of symmetry of the first module MOD1 of said group G. The first and second stage axes of symmetry ASE1 and ASE2 are superposed in this example onto the first and second axes of symmetry of the first module MOD1 of said group G. The terminals of said two first modules MOD1_3 and MOD1_4 situated at the ends of said branch B_8 indeed form the first BE11, BE12 and second terminals BE21, BE22 of said coupling stage EC.

Figure 9:
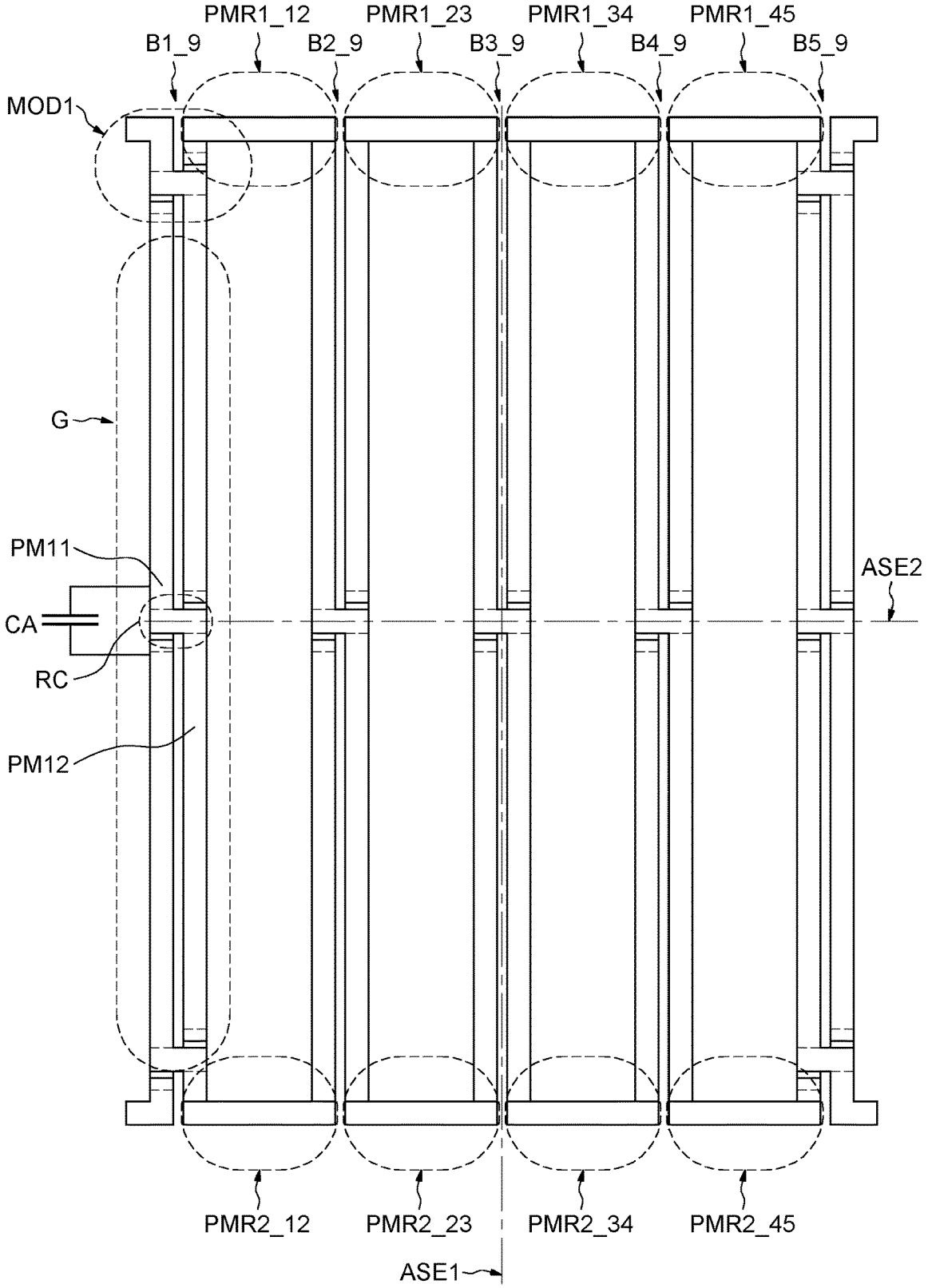

In a case illustrated in FIG. 9, the coupling stage EC may comprise several, here five, parallel branches B1_9 to B5_9. Each branch Bi_9 comprises a mixed combination of said first MOD1 and second modules MOD2. The coupling stage EC also comprises inductive metal connection tracks PMR1_12 to PMR1_45 and PMR2_12 to PMR2_45 parallel to the second stage axis of symmetry ASE2 coupled between both of the two neighboring parallel branches B1_9 to B5_9.

It should be noted that the length of the inductive metal connection tracks PMR1_12 to PMR1_45 and PMR2_12 to PMR2_45 also influences the overall inductive value of said coupling stage EC.

A fine adjustment of the overall capacitive value of said coupling stage EC is possible (FIGS. 8 and 9) by connecting at least one adjustment capacitor CA in parallel onto the superposed parts of the two first metal tracks PM11 and PM12 in the crossing region RC of said at least one first module MOD1.

Advantageously, the use of this adjustment capacitor CA allows an overall capacitive value to be obtained without much of an increase in the size of said coupling stage EC.

The coupling stage EC has an overall inductive value, an overall capacitive value, dimensional constraints measured along the two stage axes of symmetry ASE1 and ASE2.

The type of module MOD1 and/or MOD2, the number and the size of the modules, and of the connection tracks and of the adjustment capacitors CA forming said coupling stage EC are chosen so as to comply with said overall inductive value, said overall capacitive value and said dimensional constraints.

Figure 10:
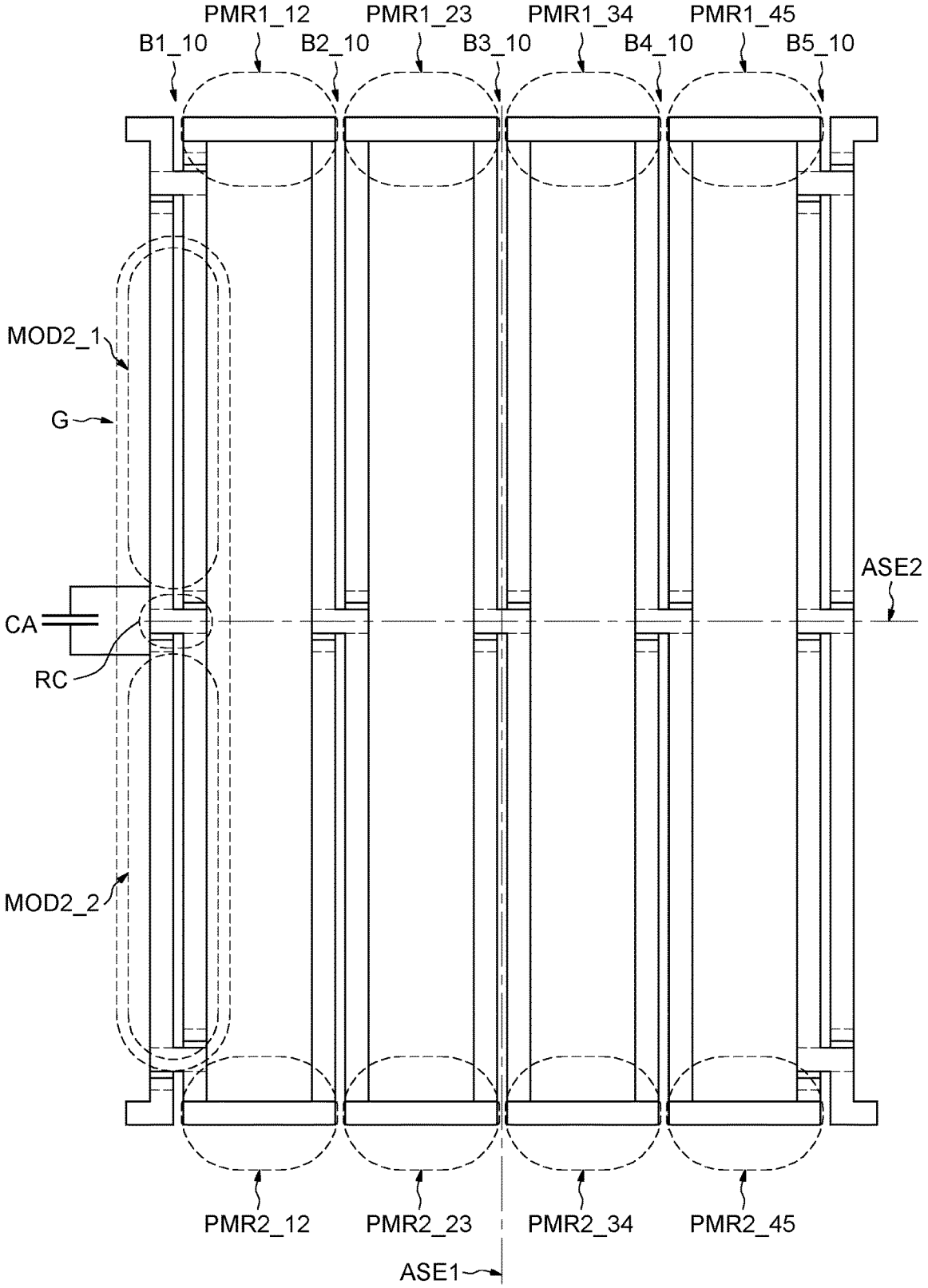
Figure 11:
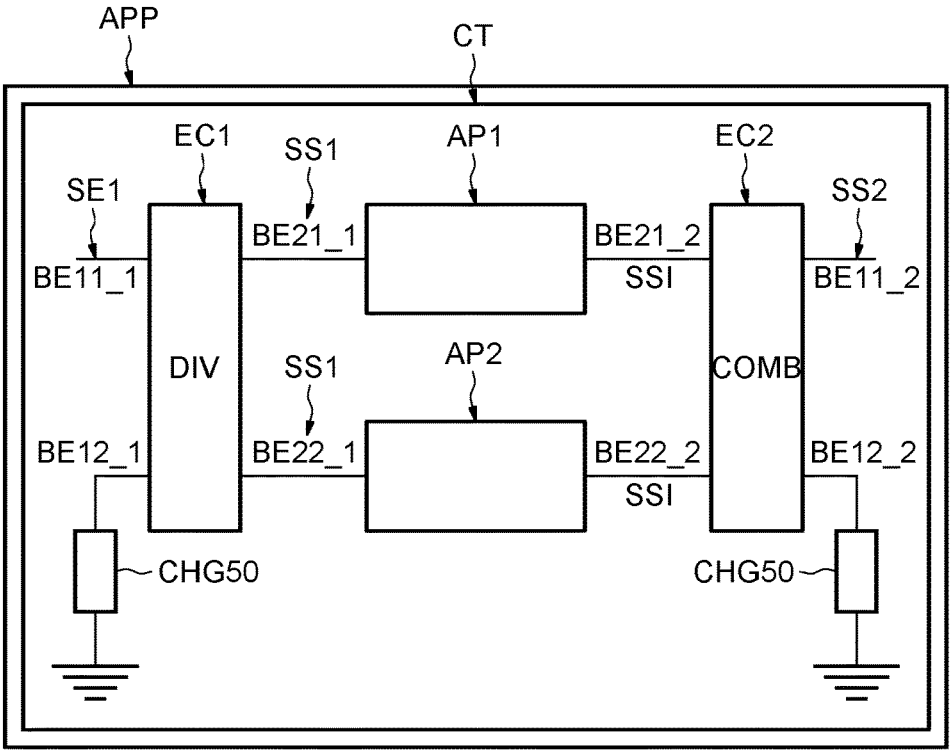
FIG. 11 illustrates schematically a wireless communications device.
Figure 12:
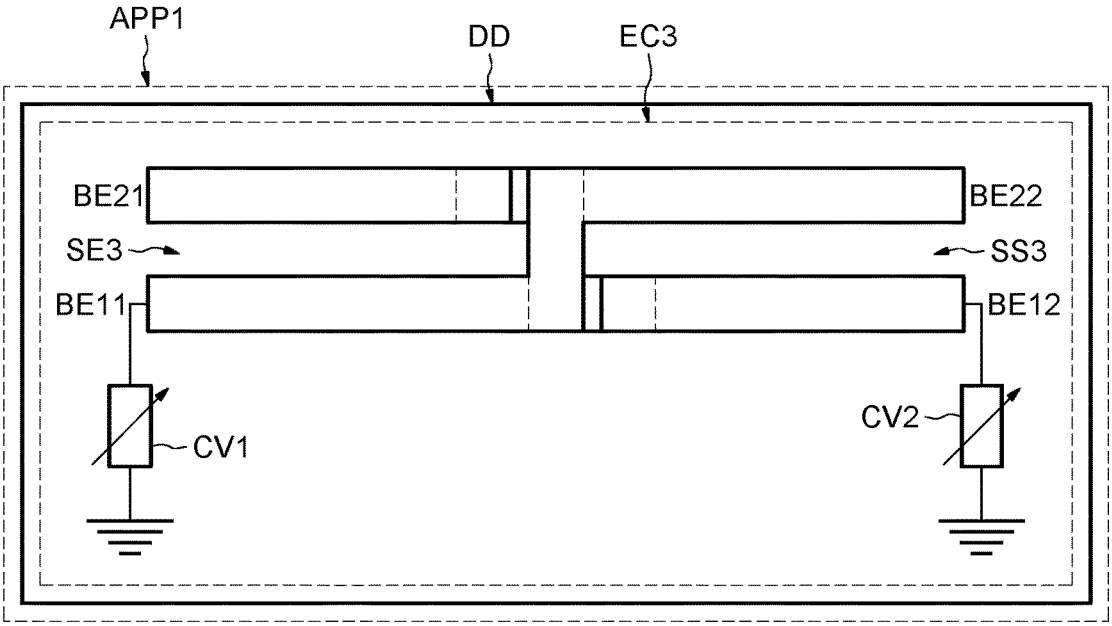
FIG. 12 illustrates an example of a coupling stage used in a phase-shift device.

Reference will now more particularly be made to FIGS. 10 to 12 in order to illustrate another example of design of a coupling stage EC.

It is assumed in this example that it is desired to form a coupling stage EC having an overall capacitive value equal to 135 fF and an overall inductive value equal to 685 pH. The distance between components, here for example power amplifiers AP, coupled to said coupling stage is for example 220 μm. The rms value of the current in the coupling stage is limited for example to 100 mA so that a minimum width for all of the metal tracks of said coupling stage EC may be determined.

As indicated hereinbefore, the effective overall capacitive value and the effective overall inductive value of said coupling stage EC are mainly determined by said first module MOD1 and said second module MOD2 of said coupling stage EC.

Consequently, said coupling stage EC illustrated in FIG. 10 comprises five branches B1_10 to B5_10 each having a group G having a first module MOD1 coupled in series between two second modules MOD2.

Each first module MOD1 of said group G has a capacitive value of 12.9 fF and an inductive value of 8 pH, whereas each second module MOD2 of said group G has a capacitive value of 17.8 fF and an inductive value of 67 pH.

In that case, if the inductive value of the first module MOD1 is ignored, each branch of said coupling stage EC has a capacitive value of around 49 fF and an inductive value of 134 pH.

In order to reach the overall inductive value of 685 pH, it is chosen to form five branches coupled via metal connection tracks PMR1 and PMR2 which are used to obtain the remainder of the overall inductive value, i.e. 15 pH. The effective overall capacitive value of the five branches is equal to 245 fF, which is close to twice the overall inductive value, i.e. 268 fF. As a consequence, an adjustment capacitor CA coupled to one of the first modules MOD1 of said coupling stage EC and having a capacitive value of 23 fF just needs to be provided.

A finer adjustment to the overall capacitive and inductive values could potentially be applied in such a manner as to adjust the central frequency of said 90° hybrid coupling stage.

FIG. 11 illustrates schematically a wireless communications device APP, for example a cellular mobile telephone, comprising a transmission chain CT containing a first coupling stage EC1 described hereinbefore being used as a power divider DIV, a second coupling stage EC2 being used as a power combiner COMB, and two power amplifiers AP1 and AP2 respectively coupled between the first coupling stage EC1 and the second coupling stage EC2.

One of the two first stage terminals BE11_1 of said first coupling stage EC1 receives a first input signal SE1, for example a radiofrequency signal coming from a frequency transformation stage, and the other of the two first stage terminals BE12_1 is coupled to a load CHG50 having a characteristic impedance of 50 ohms and being connected to ground so as to be isolated. The two second stage terminals BE21_1 and BE22_1 of said first coupling stage EC1 each deliver a first output signal SS1 and these first output signals SS1 are phase-shifted by 90° with respect to each other.

Thanks to the topology of the first and second coupling stages EC1 and EC2, the two power amplifiers AP1 and AP2 are coupled in parallel between the two second stage terminals BE21_1 and BE22_1 of said first coupling stage EC1 and the two second stage terminals BE21_2 and BE22_2 of said second coupling stage EC2, which advantageously allows the size of said device APP to be reduced.

Said second coupling stage EC2 receives, at its two second stage terminals BE21_2 and BE22_2, the intermediate output signals SSI coming from the two power amplifiers AP1 and AP2 and delivers to one of the two first stage terminals BE11_2 a second output signal SS2, for example an amplified radiofrequency signal intended to be transmitted via an antenna for example. The other of the two first stage terminals BE12_2 of said second coupling stage EC2 is coupled to a load CHG50 having a characteristic impedance of 50 ohms and being connected to ground so as to be isolated.

As a variant, FIG. 12 illustrates schematically an example of a third coupling stage EC3 used in a phase-shift device DD, incorporated for example into an apparatus APP1 such as for example a radio frequency phase-shifter.

More precisely, one of the two second stage terminals BE21 of said third coupling stage EC3 receives a third input signal SE3 and the other of the two second stage terminals BE22 delivers a third output signal SS3. The two first stage terminals BE11 and BE12 are respectively coupled to first and second variable loads CV1 and CV2 having variable impedances and being respectively connected to ground.

The phase shift between said third input signal SE3 and said third output signal SS3 is adjustable by modifying the impedances of said first and second variable loads CV1 and CV2.

Thus, a coupling device is obtained comprising a coupling stage of limited size able to be used for example as a divider, combiner or else phase-shift device, and allowing a fast and easy adjustment of the dimensions and the capacitive and inductive values of said coupling stage.

Furthermore, the fact that the input terminals of said stage in combiner mode and the output terminals of said stage in divider mode are situated in the same side of said coupling stage advantageously allows a parallel coupling of the components such as power amplifiers with a reduced space requirement.

The invention is not limited to the embodiments that have just been described but encompasses all their variants.

Thus, although coupling stages within coupling devices disposed on a substrate of the silicon type, with a dielectric between the tracks, have been described, these coupling stages may also be implemented on a printed circuit, within a packaging module or else in the air in suspended mode.

The invention claimed is:

1. A hybrid inductive-capacitive coupling stage, comprising:

a first input coupled to receive an input signal;

a second input coupled to a load having an impedance that is connected to ground;

a first output;

a second output;

wherein the first and second outputs are configured to deliver first and second output signals, respectively, from the input signal that phase-shifted by 90° with respect to each other;

a first metal track extending for a first length from a first end, which is coupled to receive the input signal from said first input, to a second end;

a second metal track inductively coupled to and extending parallel and adjacent to the first metal track for said first length from a first end, which is coupled to deliver the first output signal to said first output, to a second end;

a third metal track extending for a second length from a first end, which is coupled to the impedance at said second input, to a second end;

a fourth metal track inductively coupled to and extending parallel and adjacent to the third metal track for said second length from a first end, which is coupled to deliver the second output signal to said second output, to a second end;

wherein said first and second lengths for the first, second, third and fourth metal tracks extend parallel to a first axis of symmetry, with said first and third metal tracks on one side of said first axis of symmetry and said second and fourth metal tracks on an opposite side of said first axis of symmetry;

a fifth metal track extending between the second end of the first metal track and the second end of the fourth metal track;

a sixth metal track extending between the second end of the second track and the second end of the third metal track;

wherein the first and sixth metal tracks are insulated from each other and overlaid in a crossing region to provide a capacitive coupling;

wherein lengths of the fifth and sixth metal tracks are aligned with a second axis of symmetry, said second axis of symmetry being perpendicular to said first axis of symmetry; and wherein the first and second metal tracks are on one side of the second axis of symmetry and the third and fourth metal tracks are on an opposite side of the second axis of symmetry.

2. The stage as claimed in claim 1, wherein the first and second lengths are identical.

3. The stage as claimed in claim 1, further comprising an adjustment capacitor having a first terminal directly connected to the second end of the first metal track at the fifth metal track and a second terminal directly connected to the second end of the third metal track at the sixth metal track.

4. A hybrid inductive-capacitive coupling stage, comprising:

a first input coupled to receive a first input signal;

a second input coupled to receive a second input signal;

wherein the first and second input signals are phase-shifted by 90° with respect to each other;

a first output configured to deliver an output signal comprising a sum of the first and second input signals;

a second output coupled to a load having an impedance that is connected to ground;

a first metal track extending for a first length from a first end, which is coupled to receive the first input signal from said first input, to a second end;

a second metal track inductively coupled to and extending parallel and adjacent to the first metal track for said first length from a first end, which is coupled to deliver the output signal to said first output, to a second end;

a third metal track extending for a second length from a first end, which is coupled to receive the second input signal from said second input, to a second end;

a fourth metal track inductively coupled to and extending parallel and adjacent to the third metal track for said second length from a first end, which is coupled to the impedance at said second output, to a second end;

wherein said first and second lengths for the first, second, third and fourth metal tracks extend parallel to a first axis of symmetry, with said first and third metal tracks on one side of said first axis of symmetry and said second and fourth metal tracks on an opposite side of said first axis of symmetry;

a fifth metal track extending between the second end of the first metal track and the second end of the fourth metal track;

a sixth metal track extending between the second end of the second track and the second end of the third metal track;

wherein the first and sixth metal tracks are insulated from each other and overlaid in a crossing region to provide a capacitive coupling;

wherein lengths of the fifth and sixth metal tracks are aligned with a second axis of symmetry, said second axis of symmetry being perpendicular to said first axis of symmetry; and wherein the first and second metal tracks are on one side of the second axis of symmetry and the third and fourth metal tracks are on an opposite side of the second axis of symmetry.

5. The stage as claimed in claim 3, wherein the first and second lengths are identical.

6. The stage as claimed in claim 3, further comprising an adjustment capacitor having a first terminal directly connected to the second end of the first metal track at the fifth metal track and a second terminal directly connected to the second end of the third metal track at the sixth metal track.

7. A hybrid inductive-capacitive coupling stage, comprising:

a first terminal coupled to a first load having a first impedance that is connected to ground;

a second terminal coupled to a second load having a second impedance that is connected to ground;

a third terminal coupled to receive an input signal;

a fourth terminal coupled to generate an output signal that is phase shifted relative to the input signal;

a first metal track extending for a first length from a first end coupled to said first terminal to a second end;

a second metal track inductively coupled to and extending parallel and adjacent to the first metal track for said first length from a first end coupled to said third terminal to a second end;

a third metal track extending for a second length from a first end coupled to said second terminal to a second end;

a fourth metal track inductively coupled to and extending parallel and adjacent to the third metal track for said second length from a first end coupled to said fourth terminal to a second end;

wherein said first and second lengths for the first, second, third and fourth metal tracks extend parallel to a first axis of symmetry, with said first and third metal tracks on one side of said first axis of symmetry and said second and fourth metal tracks on an opposite side of said first axis of symmetry;

a fifth metal track extending between the second end of the first metal track and the second end of the fourth metal track;

a sixth metal track extending between the second end of the second track and the second end of the third metal track;

wherein the first and sixth metal tracks are insulated from each other and overlaid in a crossing region to provide a capacitive coupling;

wherein lengths of the fifth and sixth metal tracks are aligned with a second axis of symmetry, said second axis of symmetry being perpendicular to said first axis of symmetry; and wherein the first and second metal tracks are on one side of the second axis of symmetry and the third and fourth metal tracks are on an opposite side of the second axis of symmetry.

8. The stage as claimed in claim 7, wherein the first and second lengths are identical.

9. The stage as claimed in claim 7, further comprising an adjustment capacitor having a first terminal directly connected to the second end of the first metal track at the fifth metal track and a second terminal directly connected to the second end of the third metal track at the sixth metal track.

* * * * *